US007223066B2

(12) United States Patent
Rockley

(10) Patent No.: US 7,223,066 B2
(45) Date of Patent: May 29, 2007

(54) VARIABLE VANE ARRANGEMENT FOR A TURBOMACHINE

(75) Inventor: Christopher I Rockley, Nottingham (GB)

(73) Assignee: Rolls-Royce plc, London (GB)

( * ) Notice: Subject to any disclaimer, the term of this patent is extended or adjusted under 35 U.S.C. 154(b) by 311 days.

(21) Appl. No.: 10/844,517

(22) Filed: May 13, 2004

(65) Prior Publication Data

US 2004/0240990 A1 Dec. 2, 2004

(30) Foreign Application Priority Data

May 27, 2003 (GB) ..... 0312098.7

(51) Int. Cl.
*F01B 25/02* (2006.01)
*F01D 17/12* (2006.01)

(52) U.S. Cl. ..... 415/160; 415/209.3

(58) Field of Classification Search ..... 415/160–162
See application file for complete search history.

(56) References Cited

U.S. PATENT DOCUMENTS

| | | | |
|---|---|---|---|
| 3,788,763 | A | 1/1974 | Nickles |
| 4,307,994 | A | 12/1981 | Brewer |
| 4,979,874 | A | 12/1990 | Myers |
| 5,407,322 | A | 4/1995 | Charbonnel |
| 5,492,446 | A | 2/1996 | Hawkins |
| 5,630,701 | A | 5/1997 | Lawer |

FOREIGN PATENT DOCUMENTS

| | | |
|---|---|---|
| GB | 2 264 148 A | 8/1993 |
| GB | 2 339 244 A | 1/2000 |
| JP | 2000320494 | 11/2000 |

*Primary Examiner*—Edward K. Look
*Assistant Examiner*—Devin Hanan
(74) *Attorney, Agent, or Firm*—W. Warren Taltavull; Manelli Denison & Selter PLLC

(57) ABSTRACT

A variable vane arrangement (36) for a compressor (26) of a gas turbine engine (10) comprises a plurality of circumferentially arranged vanes (38), a plurality of operating levers (64) and a control ring (66). Each vane (38) is pivotally mounted to a casing (30) of the compressor (26). Each operating lever (64) is pivotally mounted at a first end (68) to the control ring (66) and is mounted at second end (70) to a respective one of the vanes (38). The second end (70) of each operating lever (64) comprises a multi-sided aperture (72) and each vane (38) has a multi-sided spindle (60) which locates in the multi-sided aperture (72) of the respective operating lever (64). Each operating lever (64) has a drive member (74) located in the multi-sided aperture (72) and around the multi-sided spindle (60) of the respective vane (38). Each drive member (74) engages the respective multi-sided aperture (72) and the respective multi-sided spindle (60) to transmit drive from the operating lever (64) to the vane (38).

27 Claims, 3 Drawing Sheets

VARIABLE VANE ARRANGEMENT FOR A TURBOMACHINE

FIELD OF THE INVENTION

The present invention relates to a variable vane arrangement for a turbomachine, and in particular relates to a variable vane arrangement for a compressor of gas turbine engine.

BACKGROUND OF THE INVENTION

A variable vane arrangement for a turbomachine, as disclosed in our UK patent application GB2339244A, comprises a plurality of circumferentially arranged vanes, a plurality of operating levers and a control ring. Each vane comprises an upstream portion secured to a casing and a movable downstream portion pivotally mounted to the casing of the turbomachine. Each operating lever is pivotally mounted at a first end to the control ring and each operating lever is mounted at second end to a spindle of the movable downstream portion of a respective one of the vanes. Rotation of the control ring causes the levers to adjust the angular position of the movable downstream portions of the vanes.

In this variable vane arrangement the movable downstream portions of the vanes are pivotally mounted about an axis adjacent the upstream ends of the movable downstream portions and downstream of the downstream ends of the fixed upstream portions of the vanes.

Current designs of variable vane arrangements use expensive and difficult to produce drive features between the operating levers and the spindles of the vanes. The drive features may comprise highly toleranced flat surfaces, which require intricate removal tooling and which may damage the lever and spindle on removal. If a clearance is provided to enable easier fitting and removal, there is an increase in the possibility of errors in the angular position of the vanes. During build of the variable vane arrangement it is difficult to both load the variable vane and maintain it in position while attempting to fit the highly accurate drive features.

SUMMARY OF THE INVENTION

Accordingly the present invention seeks to provide a novel variable vane assembly for a turbomachine which reduces, preferably overcomes, the above mentioned problems.

Accordingly the present invention provides a variable vane arrangement for a turbomachine comprising a plurality of circumferentially arranged vanes, a plurality of operating levers and a control ring, each vane being pivotally mounted to a casing of the turbomachine, each operating lever being pivotally mounted at a first end to the control ring, each operating lever being mounted at second end to a respective one of the vanes, the second end of each operating lever comprising a multi-sided aperture, each vane having a multi-sided spindle which locates in the multi-sided aperture of the respective operating lever, each operating lever having a drive member located in the multi-sided aperture and around the multi-sided spindle of the respective vane, each drive member engaging the respective multi-sided aperture and the respective multi-sided spindle to transmit drive from the operating lever to the vane.

Preferably the sides of each multi-sided aperture taper from a first end adjacent the respective vane to a second end remote from the respective vane such that the cross-sectional area of the aperture increases from the first end to the second end.

Preferably the sides of each multi-sided spindle taper from a first end adjacent the respective vane to a second end remote from the respective vane such that the cross-sectional area of the spindle increases from the second end to the first end.

Preferably each drive member has multiple sides on an inner surface to engage the respective multi-sided spindle and multiple sides on an outer surface to engage the respective multi-sided aperture.

Preferably each drive member tapers from a first end adjacent the respective vane to a second end remote from the respective vane such that the cross-sectional area of the drive member increases from the first end to the second end.

Preferably the sides on the inner surface taper from the first end to the second end and the sides on the outer surface taper from the first end to the second end.

Preferably each drive member comprises a base portion and a plurality of portions extending into the respective multi-sided aperture.

Preferably the base portion of each drive member is secured to the spindle of the respective vane to clamp the respective operating lever.

Preferably the base portion of each drive member is secured to the spindle of the respective vane by a screw or a bolt.

Preferably each multi-sided aperture comprises three, four, five or six sides, each multi-sided spindle has an equal number of sides to the respective multi-sided aperture.

Preferably the drive member comprises a ductile material. Preferably the ductile material comprises titanium or a plastic.

Preferably each variable vane comprises an upstream portion fixed to the casing and a movable downstream portion pivotally mounted to the casing.

Preferably the turbomachine is a gas turbine engine, preferably a turbojet or turbofan gas turbine engine.

Preferably the variable vane arrangement is for a compressor or a fan of a gas turbine engine.

The present invention also provides a variable vane operating lever comprising a first end and a second end, the first end being adapted to be pivotally mounted to a control ring, the second end having a multi-sided aperture to engage a multi-sided spindle of a variable vane.

Preferably the sides of the multi-sided aperture taper from a first end to a second end such that the cross-sectional area of the aperture increases from the first end to the second end.

The present invention also provides a variable vane drive member comprising multiple sides on an inner surface adapted to engage a multi-sided spindle of a variable vane and multiple sides on an outer surface adapted to engage a multi-sided aperture of an operating lever.

Preferably the drive member tapers from a first end to a second end such that the cross-sectional area of the drive member increases from the first end to the second end.

Preferably the sides on the inner surface taper from the first end to the second end and the sides on the outer surface taper from the first end to the second end.

Preferably the drive member comprises a base portion and a plurality of portions extending into the multi-sided aperture.

Preferably the base portion of each drive member is adapted to be secured to the spindle of the variable vane.

Preferably the drive member comprises a ductile material. Preferably the ductile material comprises titanium or a plastic.

The present invention also provides a variable vane arrangement for a turbomachine comprising a vane and an operating lever, the vane being pivotally mounted to a casing of the turbomachine, the operating lever being mounted at one end to the vane, the end of the operating lever comprising a multi-sided aperture, the vane having a multi-sided spindle which locates in the multi-sided aperture of the operating lever, the operating lever having a drive member located in the multi-sided aperture and around the multi-sided spindle of the vane, the drive member engaging the multi-sided aperture and the multi-sided spindle to transmit drive from the operating lever to the vane.

BRIEF DESCRIPTION OF THE DRAWING

The present invention will be more fully described by way of example with reference to the accompanying drawings in which.

DETAILED DESCRIPTION OF THE INVENTION

Figure 1:
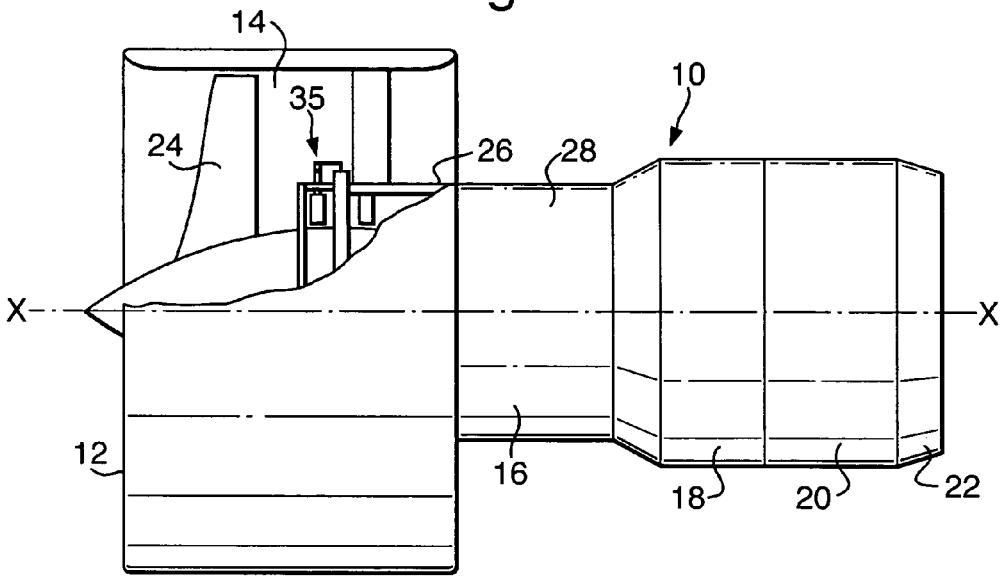
FIG. 1 is a partially cut away view of a turbofan gas turbine engine having a variable vane arrangement according to the present invention.

A turbofan gas turbine engine 10, as shown in FIG. 1, comprises in axial flow series an intake 12, a fan section 14, a compressor section 16, a combustion section 18, a turbine section 20 and a core exhaust 22. The turbine section 20 comprises a low-pressure turbine (not shown) arranged to drive a fan 24 in the fan section 14 and a high-pressure turbine (not shown) arranged to drive a high-pressure compressor 28 in the compressor section 16. The turbine section 20 may also comprise an intermediate-pressure turbine (not shown) arranged to drive an intermediate-pressure compressor 26 in the compressor section 16.

The intermediate-pressure compressor 26 comprises a casing 30 and a rotor 32 arranged for rotation about an axis X. The rotor 32 carries one or more axially spaced stages of circumferentially arranged radially outwardly extending compressor blades 34. The intermediate-pressure compressor 26 also comprises a variable vane arrangement 36 for adjusting the angle of the airflow onto the stage of compressor blades 34 immediately downstream thereof.

Figure 2:
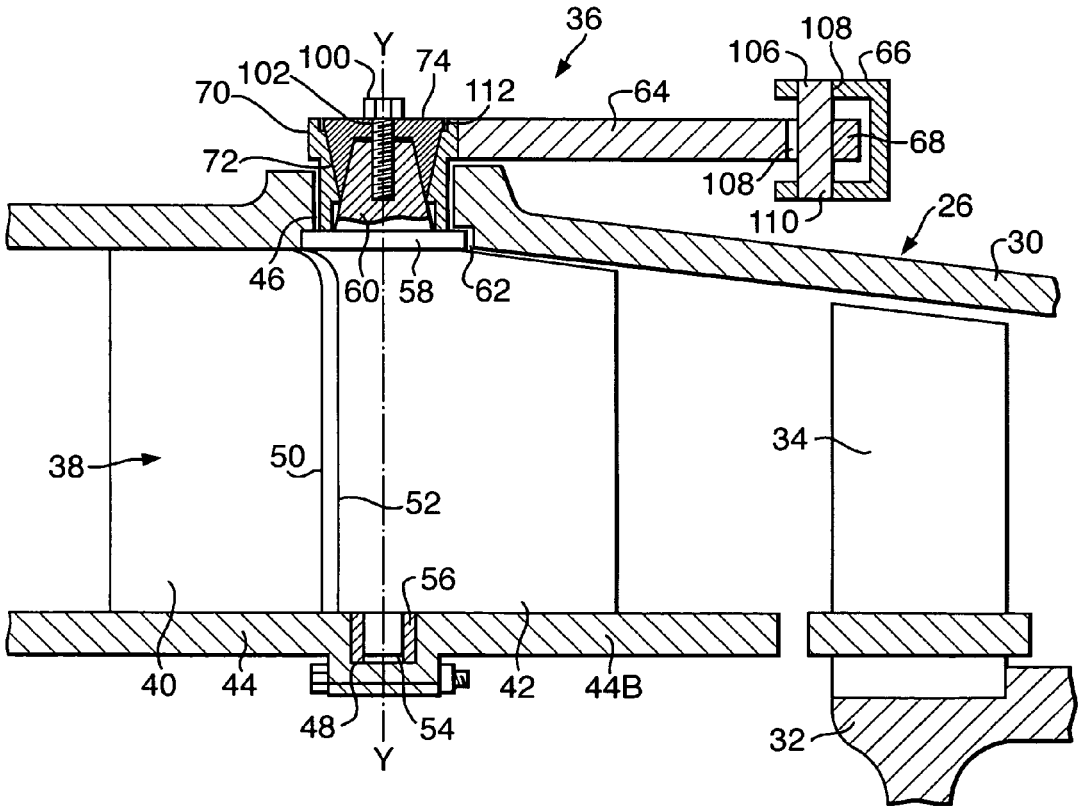
FIG. 2 is an enlarged cross-sectional view of a variable vane arrangement according to the present invention.
Figure 3:
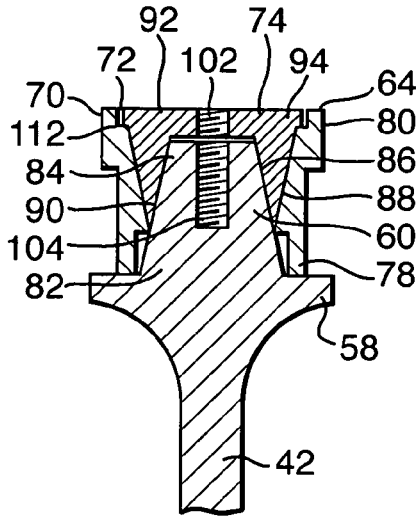
FIG. 3 is a cross-sectional view through the variable vane arrangement shown in FIG. 2.
Figure 4:
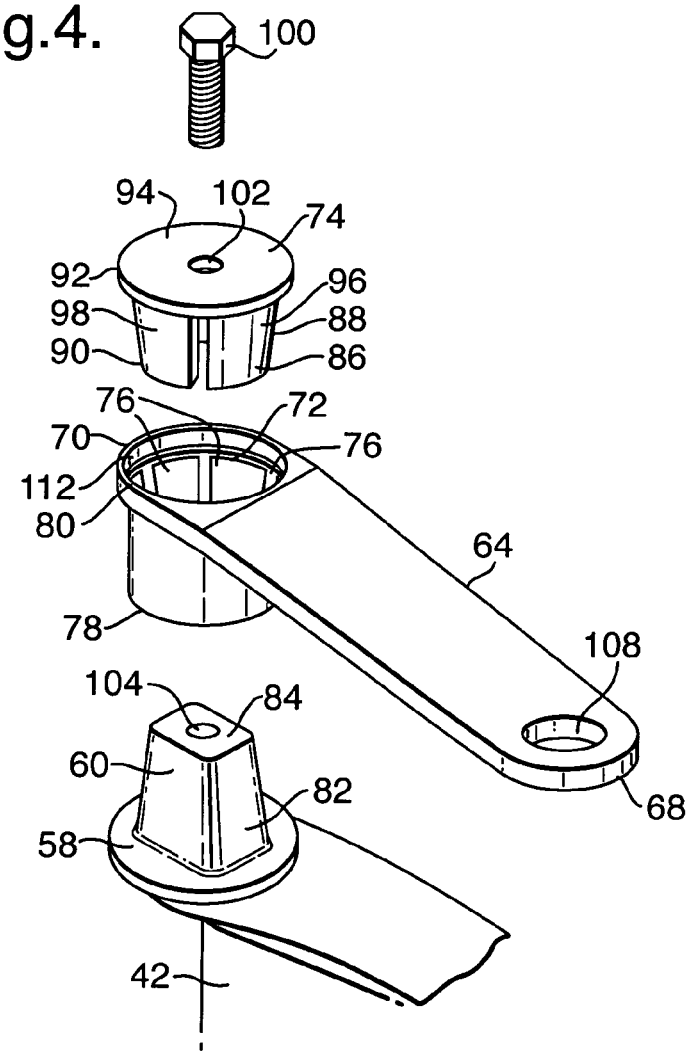
FIG. 4 is an exploded view of a spindle of a vane, an operating lever and a drive member of the variable vane arrangement shown in FIG. 2.

The variable vane arrangement 36, as shown more clearly in FIGS. 2 to 4, comprises a plurality of radially extending circumferentially arranged variable vanes 38, a plurality of operating levers 64, a control ring 66 and an actuator (not shown).

Each variable vane 38 comprises a fixed upstream portion 40 and a movable downstream portion 42. The fixed upstream portion 40 of each of the variable vanes 38 is secured at its radially outer end to the casing 30 and is secured at its radially inner end to a ring 44. The movable downstream portion 42 each of the variable vanes 38 is pivotally mounted at its radially outer end in a respective aperture 46 in the casing 30 and is pivotally mounted at its radially inner end in a respective aperture 48 in the ring 44. The movable downstream portion 42 of each of the variable vanes 38 is pivotally mounted about one of a plurality of circumferentially spaced axes Y arranged substantially in a plane arranged perpendicularly to the axis X of the rotor 32. The axes Y are arranged adjacent the upstream ends 52 of the movable downstream portions 42 of the variable vanes 38 and adjacent, slightly downstream of, the downstream ends 50 of the fixed upstream portions 40 of the variable vanes 38. The ring 44 comprises an upstream portion 44A and a downstream portion 44B, which are joined together along the radial plane containing the pivot axes Y by axially extending bolts and nuts extending through apertures in flanges on the upstream portion 44A and downstream portion 44B. The ring 44 has a plurality of circumferentially spaced apertures 48 defined between the edges of the upstream portion 44A and the downstream portion 44B of the ring 44. The radially inner end of the movable downstream portion 42 of each of the variable vanes 38 is provided with a cylindrical spindle 54 which locates coaxially in a bearing member, or bush, 56 in the respective aperture 48 in the ring 44. The radially outer end of the movable downstream portion 42 of each of the variable vanes 38 is provided with a cylindrical bearing member 58 and a spindle 60. The bearing member 58 locates coaxially in an increased diameter portion 62 of the respective aperture 46 in the casing 30.

Each operating lever 64 is pivotally mounted at a first end 68 to the control ring 66 and each operating lever 64 is pivotally mounted at a second end 70 to the movable downstream portion 42 of a respective one of the variable vanes 38. The second end 70 of each operating lever 64 forms a cylindrical bush for location coaxially in the respective aperture 46 in the casing 30. The second end 70 of each operating lever 64 comprises a multi-sided aperture 72 and the movable downstream portion 42 of each variable vane 38 has a multi-sided spindle 60 which locates in the multi-sided aperture 72 of the respective operating lever 64. Each operating lever 64 has a drive member 74 located in the multi-sided aperture 72 and around the multi-sided spindle 60 of the movable downstream portion 42 of the respective variable vane 38. Each drive member 74 engages the respective multi-sided aperture 72 and the respective multi-sided spindle 60 to transmit drive from the operating lever 64 to the movable downstream portion 42 of the respective variable vane 38.

The sides 76 of each multi-sided aperture 72 taper from a first end 78 adjacent the movable downstream portion 42 of the respective variable vane 38 to a second end 80 remote from the movable downstream portion 42 of the respective variable vane 38. Thus the cross-sectional area of the aperture 72 increases from the first end 78 to the second end 80. The sides of each multi-sided spindle 60 taper from a first end 82 adjacent the movable downstream portion 42 of the respective variable vane 38 to a second end 84 remote from the movable downstream portion 42 of the respective variable vane 38. Thus the cross-sectional area of the spindle 60 increases from the second end 84 to the first end 82.

Each drive member 74 has multiple sides on an inner surface 86 to engage the respective multi-sided spindle 60 and multiple sides on an outer surface 88 to engage the respective multi-sided aperture 72 in the second end 70 of the operating lever 64. Each drive member 74 tapers from a first end 90 adjacent the movable downstream portion 42 of the respective variable vane 38 to a second end 92 remote from the movable downstream portion 42 of the respective variable vane 38. Thus the cross-sectional area of the drive member 74 increases from the first end 90 to the second end 92. The sides on the inner surface 86 taper from the first end 90 to the second end 92 and the sides on the outer surface 88 taper from the first 90 end to the second end 92. Each drive member 74 comprises a base portion 94 and a plurality of portions 96, 98, corresponding in number to the number of sides of the aperture 72 and the spindle 60, extending into the respective multi-sided aperture 72. Each drive member 74 comprises a ductile material, for example the ductile material comprises titanium, a plastic or other suitable material. The drive member 74 is split at the corner positions such that the portions 96, 98 are separate from each other so that they act as a collet to maintain drive from the operating lever 64 to the spindle 60 of the variable vane 38.

The base portion 94 of each drive member 74 is secured to the spindle 60 of the movable downstream portion 42 of the respective variable vane 38 by a screw, or a bolt, 100. Each screw, or bolt, 100 extends though an aperture 102 in the base portion 94 of the drive member 74 and into a threaded aperture 104 in the spindle 60 of the variable vane 38. Each multi-sided aperture 72 comprises three, four, five, six or more sides, each multi-sided spindle 60 has an equal number of sides to the respective multi-sided aperture 72 in the second end 70 of the operating lever 64. Similarly the each drive member 74 has an equal number of side to the respective multi-sided aperture 72 and the respective spindle 60.

Each aperture 72 in the second end 70 of the respective operating lever 64 has a increased dimension seating position 112 at the end 80 remote from the movable downstream portion 42 of the variable vane 38. The seating position 112 has substantially the same dimensions and shape as the base portion 94 of the respective drive member 74. The base portion 94 of the drive member 74 locates on the seating position 112 in the aperture 72 in the operating lever 64 when the bolt 100 is fully tightened. In this example the seating position 112 and the base portion 94 are circular, but other suitable shapes may be used.

The first end 68 of each operating lever 64 is pivotally mounted to the control ring 66 by a respective pin, or bolt, 106. Each pin, or bolt, 106 passes through an aperture 108 in the first end 68 of the operating lever 64 and the pin, or bolt, 106 is secured, threaded, into apertures 109, 110 in the control ring 66.

The control ring 66 is arranged coaxially around the axis X of the rotor 32 of the intermediate-pressure compressor 26 and is rotatably mounted on the casing 30 so as to vary the angles of the variable vanes 38. An actuator (not shown) is provided to rotate the control ring 66 and the actuator may be a hydraulic, pneumatic or electric actuator.

To assemble the variable vane arrangement 36 the movable downstream portion 42 of each variable vane 38 is located in the casing 30 and the spindle 60 is inserted into the inner end of the respective aperture 46 in the casing 30. The increased clearance provided by the aperture 46 in the casing 30 allows the movable downstream portion 42 of the variable vane 38 to be manoeuvred into position. The second end 70 of the operating lever 64 is then loaded into the radially outer end of the respective aperture 46 in the casing 30 around the spindle 60 on the movable downstream portion 42 of the respective variable vane 38. The movable downstream portion 42 of the variable vane 38 may be further adjusted and set in position along with any end float. The drive member 74 is then loaded into the aperture 72 in the second end 70 of the operating lever 64. The bolt 100 is then used to secure the drive member 74 and second end 70 of the operating lever 64 to the spindle 60 of the variable vane 38. The tightening of the bolt 100 causes the drive member 74 to grip the spindle 60 of the variable vane 38 and to pull the drive member 74 into the seating position 112 around the aperture 72 in the second end 70 of the operating lever 64. Any variation in geometry and/or tolerance is taken up either by movement of the drive member 74 along the taper or by deformation of the drive member 74. Once fully assembled substantially zero backlash is achieved in the drive between the operating lever 64 and the spindle 60 of the variable vane 38, thus eliminating errors in the angle setting of the variable vane 38.

The spindle 54 of the movable downstream portion 42, and the associated bush 56, of each variable vane 38 is inserted into the upstream portion of the respective aperture 48 in the upstream portion 44A of the ring 44 at any time after the spindle 60 of the movable downstream portion 42 of the variable vane 38 has been inserted into the respective aperture 48 in the casing 30. The downstream portion 44B of the ring 44 is then secured to the upstream portion 44A of the ring 44, to complete the apertures 46 around the spindles 54 of the movable downstream portion 42 of the variable vanes 38, by fastening the flanges together using the bolts and nuts.

The present variable vane arrangement has many advantages. The operating lever incorporates a bush at the end mounted onto the spindle of the variable vane to provide an increased surface area of contact with the spindle of the variable vane and thereby reduce stress loads in the spindle of the variable vane. The drive member is provided to take up the remaining space between the spindle of the variable vane and the aperture in the end of the operating lever to provide the required drive. The drive member is provided with a double taper, there is a taper on its inner surface and its outer surface, so that when the bolt is tightened to lock the drive member and operating lever to the spindle of the variable vane, the drive member removes any clearances/spaces between the operating lever and the spindle of the variable vane and hence removes/minimises errors in the setting of the angles of the variable vane. The drive member is split to provide separate portions, which allow the drive member to act as a collet. The drive member is manufactured from a ductile material, which allows the drive member to deform, to limit damage to the operating lever and the spindle of the variable vane. The drive member is a disposable item, which may be replaced during regular maintenance and/or servicing of the variable vane arrangement. The drive member moves along the double taper to take up its own seating position and thus take up manufacturing errors in the spindle and/or the aperture in the operating lever. The variable vane arrangement is easier to build.

The variable vane arrangement may be a variable inlet guide vane for the compressor or the variable vane arrangement may be arranged at any other suitable position in the compressor.

Figure 5:
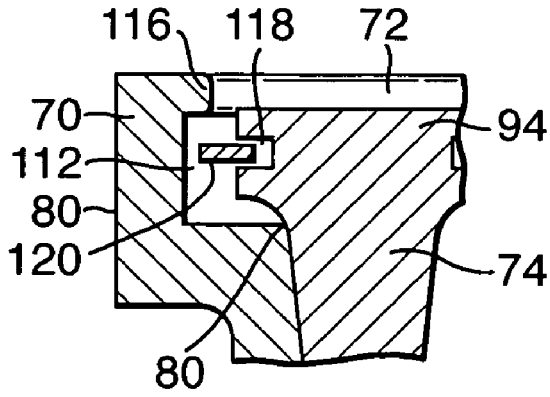
FIG. 5 is an enlarged cross-sectional view of part fan alternative operating lever and drive member of a variable vane arrangement.
Figure 6:
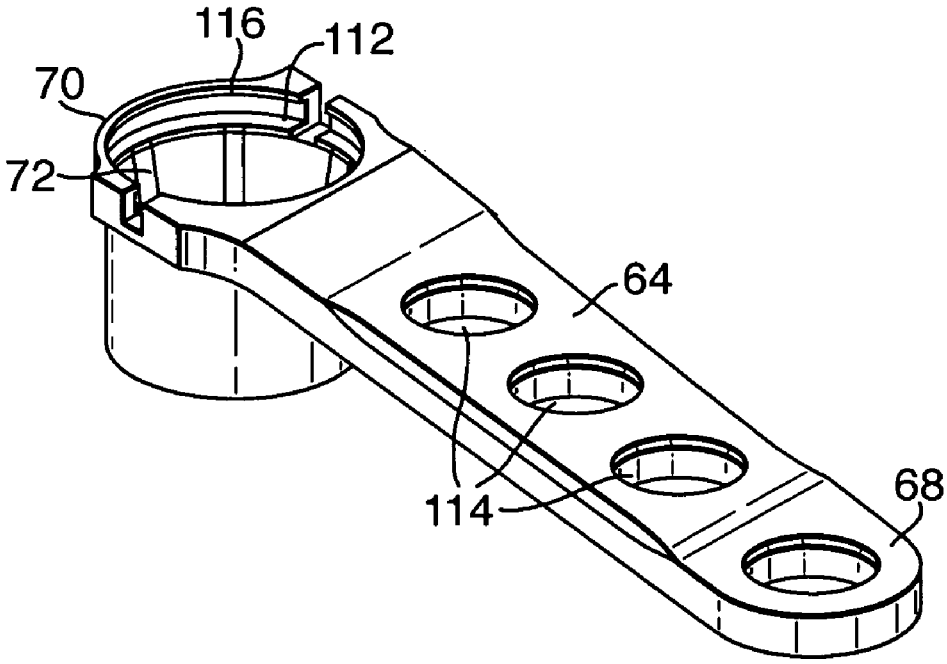
FIG. 6 is a perspective view of the alternative operating lever shown in FIG. 5.

The embodiment of variable vane arrangement 36B, as shown in FIGS. 5 and 6 is substantially the same as that shown in FIGS. 2 to 4 and like parts are denoted by like numerals. The embodiment in FIGS. 5 and 6 differs in that the operating lever 64 is provided with a plurality of apertures 114 to reduce the weight of the operating lever. In addition the second end 70 of each operating lever 64 is provided with a radially inwardly extending flange 116 around the aperture 72 and spaced axially from the seating position 112. The base portion 94 of each drive member 74 is provided with an annular groove 118 which extends radially into the periphery of the base portion 94. A corresponding ring 120 is provided within the annular groove 118 of each drive member 74 to act as a secondary retention feature for the operating levers 68 if the bolt fails. The outer diameter of the ring 120 is greater than the inner diameter of the flange 116. The rings 120 may be circlips or split rings to allow installation of the rings 120 and drive members 74 within the second ends 70 of the operating levers 64 while retaining the drive members 74 and operating levers 64 on the spindles 54 of the variable vanes 38.

The integral bush on the operating lever is arranged to aid retention of the operating lever on the spindle of the vane in the event of a failure of the bolt. The integral bush also determines the distance between the second end of the operating lever and a datum face on top of the spindle of the vane.

It is preferred that the axes of rotation of the variable vanes are inclined to the plane arranged perpendicularly to the axis of the rotor, for example at an angle of 9°-10° forward of the plane. In the event of a bolt failure the operating lever is maintained in a boss around the aperture in the casing because of the integral bush on the operating lever and because the axes of rotation of the variable vanes are inclined. For the operating lever to become disengaged the pin or bolt securing the first end of the operating lever to the control ring must also fail and the first end of the operating lever must then become disengaged from a pocket within the control ring. A number of other operating levers must be removed to allow the failed operating lever to be completely disengaged. The first end of the operating levers and the pockets in the control ring are designed to prevent an operating lever jamming in the event of failure.

Although the present invention has been described with reference to the use of a variable vane arrangement comprising variable vanes with a fixed upstream portion and a movable downstream portion it may be used for a variable vane arrangement where the upstream portion is movable and the downstream portion is fixed or if the whole of the vane is movable.

Although the present invention has been described with reference to the use of a variable vane arrangement for a compressor it may be used for a variable vane arrangement for a fan or a turbine.

Although the present invention has been described with reference to the use of a variable vane arrangement for an intermediate-pressure compressor it may be used for a high-pressure compressor, a low-pressure compressor or a fan.

Although the present invention has been described with reference to a variable vane arrangement for a turbofan gas turbine engine it may be used for a turbojet gas turbine engine, a turboprop gas turbine engine, an industrial gas turbine engine or a marine gas turbine engine.

Although the present invention has been described with reference to the use of a variable vane arrangement for a gas turbine engine it may be used for a variable vane arrangement for any other type of turbomachine.

Although the present invention has been described with reference to a variable vane arrangement for an axial flow arrangement it may be used for a radial flow arrangement.

I claim:

1. A variable vane arrangement for a turbomachine comprising a plurality of circumferentially arranged vanes, a plurality of operating levers and a control ring, each vane being pivotally mounted to a casing of the turbomachine, each operating lever being pivotally mounted at a first end to the control ring, each operating lever being mounted at a second end to a respective one of the vanes, the second end of each operating lever comprising a multi-sided aperture, each vane having a multi-sided spindle which locates in the multi-sided aperture of the respective operating lever, each operating lever having a drive member located in the multi-sided aperture and around the multi-sided spindle of the respective vane, each drive member engaging the respective multi-sided aperture and the respective multi-sided spindle to transmit drive from the operating lever to the vane wherein the sides of each multi-sided aperture taper from a first end adjacent the respective vane to a second end remote from the respective vane such that the cross-sectional area of the aperture increases from the first end to the second end.

2. A variable vane arrangement as claimed in claim 1 wherein the sides of each multi-sided aperture taper from a first end adjacent the respective vane to a second end remote from the respective vane such that the cross-sectional area of the spindle increases from the second end to the first.

3. A variable vane arrangement as claimed in claim 1 wherein each drive member has multiple sides on an inner surface to engage the respective multi-sided spindle and multiple sides on an outer surface to engage the respective multi-sided aperture.

4. A variable vane arrangement as claimed in claim 1 wherein each multi-sided aperture comprises at least three sides, each multi-sided spindle has an equal number of sides to the respective multi-sided aperture.

5. A variable vane arrangement for a turbomachine comprising a plurality of circumferentially arranged vanes, a plurality of operating levers and a control ring, each vane being pivotally mounted to a casing of the turbomachine, each operating lever being pivotally mounted at a first end to the control ring, each operating lever being mounted at a second end to a respective one of the vanes, the second end of each operating lever comprising a multi-sided aperture, each vane having a multi-sided spindle which locates in the multi-sided sided aperture of the respective operating lever, each operating lever having a drive member located in the multi-sided aperture and around the multi-sided spindle of the respective vane, each drive member engaging the respective multi-sided aperture and the respective multi-sided spindle to transmit drive from the operating lever to the vane wherein each drive member has multiple sides on an inner surface to engage the respective multi-sided spindle and multiple sides on an outer surface to engage the respective multi-sided aperture wherein each drive member tapers from a first end adjacent the respective vane to a second end remote from the respective vane such that the cross-sectional area of the drive member increases from the first end to the second end.

6. A variable vane operating lever for a turbomachine comprising a first end and a second end, the first end being adapted to be pivotally mounted to a control ring, the second end having a multi-sided aperture to engage a multi-sided spindle of a variable vane and a drive member wherein the sides of said multi-sided aperture taper from a first end adjacent said vane to a second end remote from said vane such that the cross-sectional area of the aperture increases from the first end to the second end.

7. A variable vane drive member for a turbomachine comprising multiple sides on an inner surface adapted to engage a multi-sided spindle of a variable vane and multiple sides on an outer surface adapted to engage a multi-sided aperture of an operating lever and a drive member wherein said drive member tapers from a first end adjacent said spindle to a second end remote from said spindle such that the cross-sectional area of said drive member increases from the first end to the second end.

8. A variable vane drive member as claimed in claim 7 wherein the sides on the inner surface taper from the first end to the second end and the sides on the outer surface taper from the first end to the second end.

9. A variable vane drive member as claimed in claim 8 wherein the drive member comprises a base portion and a plurality of portions extending into the multi-sided aperture.

10. A variable vane drive member as claimed in claim 9 wherein the base portion of each drive member is adapted to be secured to the spindle of a variable vane.

11. A variable vane drive member as claimed in claim 7 wherein the drive member comprises a ductile material.

12. A variable vane drive member as claimed in claim 11 wherein the ductile material comprises titanium or a plastic.

13. A variable vane arrangement for a turbomachine comprising a vane and an operating lever, the vane being pivotally mounted to a casing of the turbomachine, the operating lever being mounted at one end to the vane, the end of the operating lever comprising a multi-sided aperture, the vane having a multi-sided spindle which locates in the multi-sided aperture of the operating lever, the operating lever having a drive member located in the multi-sided aperture and around the multi-sided spindle of the vane, the drive member engaging the multi-sided aperture and the multi-sided spindle to transmit drive from the operating lever to the vane wherein the sides of each multi-sided aperture taper from a first end adjacent the respective vane to a second end remote from the respective vane such that the cross-sectional area of the aperture increases from the first end to the second end wherein the sides of each multi-sided spindle taper from a first end adjacent the respective vane to a second end remote from the respective vane such that the cross-sectional area of the spindle increases from the second end to the first end wherein each drive member has multiple sides on an inner surface to engage the respective multi-sided spindle and multiple sides on an outer surface to engage the respective multi-sided aperture wherein each drive member tapers from a first end adjacent the respective vane to a second end remote from the respective vane such that the cross-sectional area of the drive member increases from the first end to the second end.

14. A variable vane arrangement for a turbomachine comprising a plurality of circumferentially arranged vanes, a plurality of operating levers and a control ring, each vane being pivotally mounted to a casing of the turbomachine, each operating lever being pivotally mounted at a first end to the control ring, each operating lever being mounted at a second end to a respective one of the vanes, the second end of each operating lever comprising a multi-sided aperture, each vane having a multi-sided spindle which locates in the multi-sided aperture of the respective operating lever, each operating lever having a drive member located in the multi-sided apertures and around the multi-sided spindle of the respective vane, each drive member engaging the respective multi-sided aperture and the respective multi-sided spindle to transmit drive from the operating lever to the vane, wherein the sides of each multi-sided aperture taper from a first end adjacent the respective vane to a second end remote from the respective vane such that the cross-sectional area of the aperture increases from the first end to the second end, wherein the sides of each multi-sided spindle taper from a first end adjacent the respective vane to a second end remote from the respective vane such that the cross-sectional area of the spindle increases from the second end to the first end, each drive member has multiple sides on an inner surface to engage the respective multi-sided spindle and multiple sides on an outer surface to engage the respective multi-sided aperture, and each drive member tapers from a first end adjacent the respective vane to a second end remote from the respective vane such that the cross-sectional area of the drive member increases from the first end to the second end.

15. A variable vane arrangement as claimed in claim 14 wherein the sides on the inner surface taper from the first end to the second end and the sides on the outer surface taper from the first end to the second end.

16. A variable vane arrangement as claimed in claim 14 wherein each drive member comprises a base portion and a plurality of portions extending into the respective multi-sided aperture.

17. A variable vane arrangement as claimed in claim 16 wherein the base portion of each drive member is secured to the spindle of the respective vane to clamp the respective operating lever.

18. A variable vane arrangement as claimed in claim 17 wherein the base portion of each drive member is secured to the spindle of the respective vane by a screw or a bolt.

19. A variable vane arrangement as claimed in claim 14 wherein the drive member comprises a ductile material.

20. A variable vane arrangement as claimed in claim 19 wherein the ductile material comprises titanium or a plastic.

21. A variable vane arrangement as claimed in claim 14 wherein the variable vanes are pivotally mounted about pivot axes arranged substantially radially to the axis of the turbomachine.

22. A variable vane arrangement as claimed in claim 14 wherein each variable vane comprises an upstream portion fixed to the casing and a movable downstream portion pivotally mounted to the casing.

23. A variable vane arrangement as claimed in claim 14 wherein the turbomachine is a gas turbine engine.

24. A variable vane arrangement as claimed in claim 23 wherein the turbomachine is a turbojet or turbofan gas turbine engine.

25. A variable vane arrangement as claimed in claim 23 wherein the variable vane arrangement is for a compressor or a fan.

26. A variable vane arrangement for a turbomachine comprising a plurality of circumferentially arranged vanes, a plurality of operating levers and a control ring, each vane being pivotally mounted to a casing of the turbomachine, each operating lever being pivotally mounted at a first end to the control ring, each operating lever being mounted at a second end to a respective one of the vanes, the second end of each operating lever comprising a multi-sided aperture, each vane having a multi-sided spindle which locates in the multi-sided aperture of the respective operating lever, each operating lever having a drive member located in the multi-sided aperture and around the multi-sided spindle of the respective vane, each drive member engaging the respective multi-sided aperture and the respective multi-sided spindle to transmit drive from the operating lever to the vane wherein the sides of each multi-sided aperture taper from a first end adjacent the respective vane to a second end remote from the respective vane such that the cross-sectional area of the aperture increases from the first end to the second end wherein each drive member has multiple sides on an inner surface to engage the respective multi-sided spindle and multiple sides on an outer surface to engage the respective multi-sided aperture wherein each drive member tapers from a first end adjacent the respective vane to a second end remote from the respective vane such that the cross-sectional area of the drive member increases from the first end to the second end.

27. A variable vane arrangement for a turbomachine comprising a plurality of circumferentially arranged vanes, a plurality of operating levers and a control ring, each vane being pivotally mounted to a casing of the turbomachine, each operating lever being pivotally mounted at a first end to the control ring, each operating lever being mounted at a second end to a respective one of the vanes, the second end of each operating lever comprising a multi-sided aperture, each vane having a multi-sided spindle which locates in the multi-sided aperture of the respective operating lever, each operating lever having a drive member located in the multi-sided aperture and around the multi-sided spindle of the respective vane, each drive member engaging the respective multi-sided aperture and the respective multi-sided spindle to transmit drive from the operating lever to the vane wherein the sides of each multi-sided spindle taper from a first end adjacent the respective vane to a second end remote from the respective vane such that the cross-sectional area of the spindle increases from the second end to the first end wherein each drive member has multiple sides on an inner surface to engage the respective multi-sided spindle and multiple sides on an outer surface to engage the respective multi-sided aperture wherein each drive member tapers from a first end adjacent the respective vane to a second end remote from the respective vane such that the cross-sectional area of the drive member increases from the first end to the second end.

* * * * *